United States Patent [19]

Doyle

[11] Patent Number: 4,522,603

[45] Date of Patent: Jun. 11, 1985

[54] WATER SKI BINDINGS

[76] Inventor: Keith H. Doyle, 10758 133rd Ave. E., Puyallup, Wash. 98371

[21] Appl. No.: 542,202

[22] Filed: Oct. 14, 1983

[51] Int. Cl.[3] ..... A63C 5/00

[52] U.S. Cl. ..... 441/70; 441/68

[58] Field of Search ..... 441/70, 68, 65; 280/623; 156/245; 264/241; 428/212, 217

[56] References Cited

U.S. PATENT DOCUMENTS

| | | | |
|---|---|---|---|
| 2,910,709 | 11/1959 | Goodenow | 441/70 |
| 3,121,891 | 2/1964 | Humason | 441/70 |
| 3,950,483 | 4/1976 | Spier | 264/241 |
| 4,010,235 | 3/1977 | Yardley | 264/241 |
| 4,255,369 | 3/1981 | Napier | 441/70 |
| 4,309,376 | 1/1982 | Ueno | 264/241 |
| 4,389,200 | 6/1983 | O'Brien | 441/70 |

*Primary Examiner*—Trygve M. Blix
*Assistant Examiner*—C. T. Bartz
*Attorney, Agent, or Firm*—Quaintance & Murphy

[57] ABSTRACT

A molded water ski binding having a soft, pliable binding rubber portion and a hard framework portion bonded to the binding rubber portion during the molding process.

18 Claims, 14 Drawing Figures

WATER SKI BINDINGS

FIELD OF INVENTION

This invention relates to foot-restraining bindings for water skis.

BACKGROUND

Water ski bindings typically comprise a flexible, soft, natural or artificial rubber piece (which is customarily referred to as the binding rubber) which is constrained by a rigid, separately formed framework to pucker up and thereby form a pocket for receiving a portion of the skier's foot, such as the skier's forefoot in the case of a front binding or the skier's heel in the case of a heel piece binding or heel cup, as it is also called. The binding rubber is conventionally clamped between the rigid framework and the ski and is fastened in place usually by screws which extend through holes in the framework and the binding rubber. It is expressly understood that the binding rubber mentioned above is a flexible part which, unless otherwise indicated, may be made from natural rubber or a plastic or artificial material.

Due to the substantial pressure applied to the binding rubber by the skier while skiing, the binding rubber tends to be pulled away from the framework and fastening screws, causing the binding rubber to tear and therefore fail in the region of some of the screw holes. For a front or toe piece binding, the failure usually occurs at the rearmost screw holes nearest the free ends of the clamping frame. For a rear toe binding, failure also usually occurs at the rearmost screw holes nearest the foot.

The foregoing problem is aggravated by the current practice of making the binding rubber from a plastic material rather than latex. When formulated to have the same elongation as natural rubber, plastic binding rubbers are not as strong as natural rubber and therefore are more likely to fail. If formulated to have the same tensile strength as natural rubber, on the other hand, plastic binding rubbers do not have as much stretch or elongation as natural rubber and therefore are less comfortable and more difficult to fit around the skier's foot.

SUMMARY AND OBJECTS OF INVENTION

With the foregoing in mind, it is the general aim and purpose of my invention to provide a novel water ski binding which significantly alleviates, if not eliminates, the foregoing failure problem. This is accomplished by molding (i.e., bonding) a tough, hard framework of high tensile strength directly to the soft binding rubber during the molding process. Rather than being separate from the binding rubber as in conventional bindings, the framework in this invention is therefore firmly joined to the binding rubber as a single molded part.

The bonded framework portion extends along the perimeter of the binding rubber portion and is formed with holes for receiving the screw or other fasteners which are used to fasten the binding to the ski or to a binding plate.

As compared with conventional binding constructions, the unitary binding of this invention can withstand considerably greater stresses without tearing because of the large bonded interface between the framework and binding rubber portions.

The unique binding construction of this invention offers the additional advantage of permitting the binding rubber portion to be made from a plastic which is as soft and stretchable as natural rubber without resulting in tearing when subjected to the relatively high stresses during usage. The binding rubber in the binding of this invention therefore flexes easily and provides a comfortable fit around the skier's foot.

Furthermore, as compared with the conventional two-piece binding assembly in which the clamping framework is formed separately of the binding rubber, the binding of this invention is cheaper to manufacture, cheaper and easier to install on the ski, and reduces inventory costs. Still further, the equipment used to mold the binding of this invention may be a relatively inexpensive type, thus eliminating the high cost of injection molds used in manufacturing conventional bindings.

In one embodiment of this invention, the transverse cross section of the hard framework portion is elongated in a direction extending parallel to the binding rubber in its flattened, unflexed state, and the screw holes are formed through both the framework and binding rubber portions. In another embodiment, the transverse cross section of the hard framework portion is elongated normal to the plane of the binding rubber and the screw holes are formed only through the framework portion. This latter embodiment affords a reduction in the maximum width of the binding without reducing the size of the binding's foot-receiving pocket. The water ski may therefore be made narrower for improved maneuverability without requiring a reduction in the foot-receiving pocket size, and thus avoiding a tight, discomforting fit around the skier's foot and making it easier for the skier to insert his foot into the binding.

The procedure for molding the binding of this invention is relatively simple and mainly comprises the steps of pouring the resin for the framework portion into a channel in a suitable mold, then pouring the resin for the binding rubber portion into the mold over the framework portion, thereafter heating the mold to gel and cure the composite of the resins.

It will be appreciated that the principles of this invention are applicable to all types of water ski bindings such as front, toe piece bindings, heel piece bindings, and rear, toe piece bindings.

Although shown in a slalom ski, it will be appreciated that the bindings of this invention may be used with any other type of water ski such as a conventional ski pair or a trick ski.

DETAILED DESCRIPTION

Figure 1:
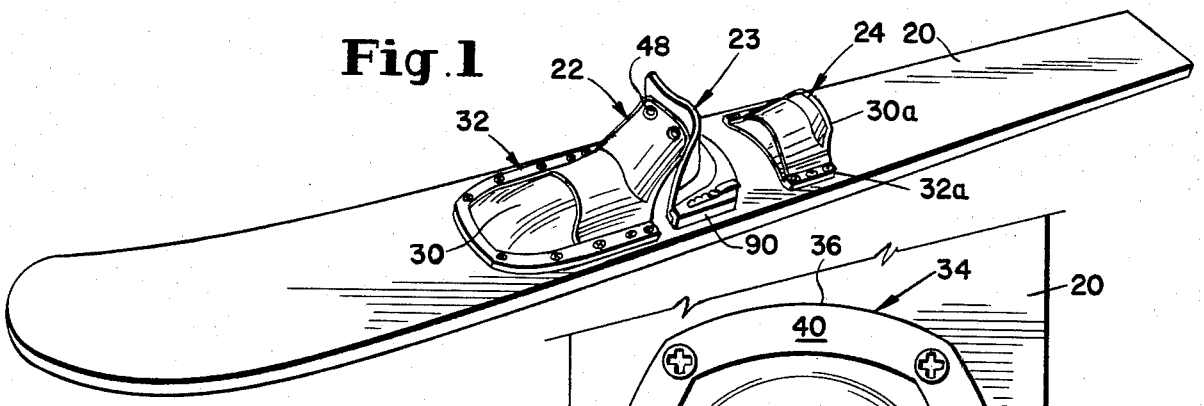
FIG. 1 is a perspective view of a slalom water ski in which the bindings incorporate the principles of this invention.
Figure 2:
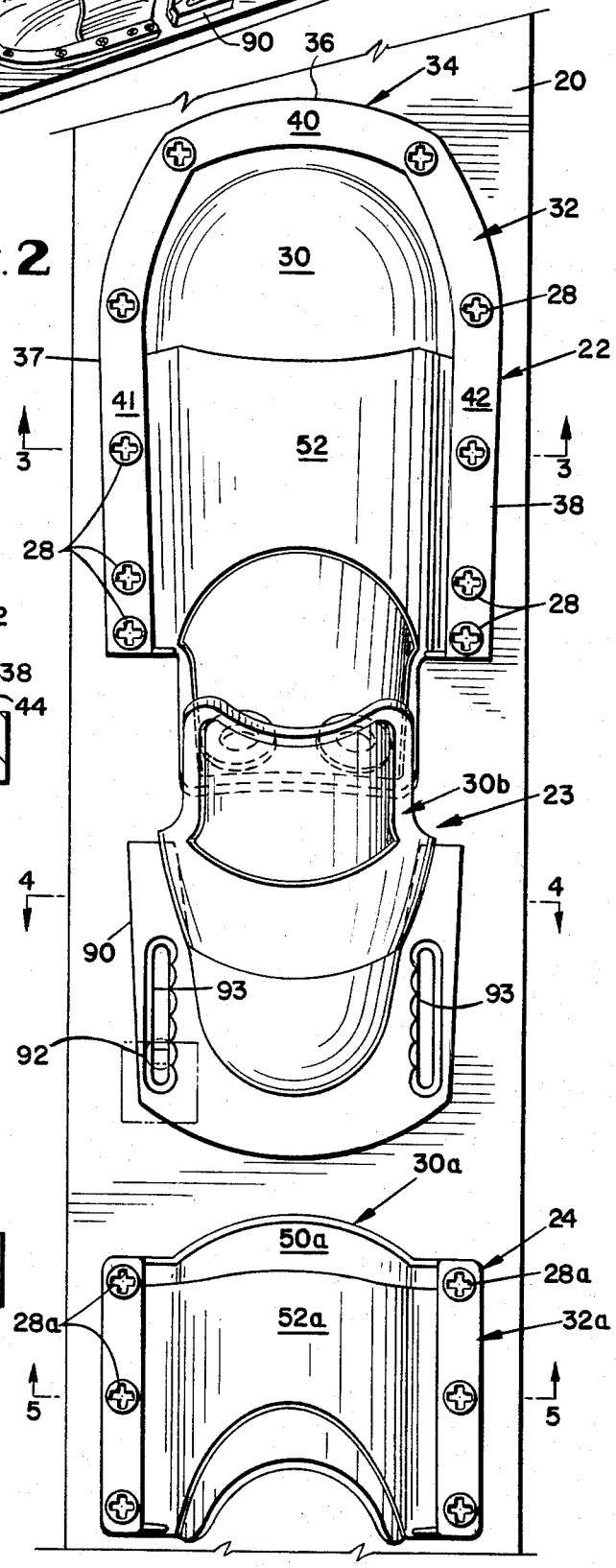
FIG. 2 is an enlarged fragmentary plan view of the ski portion containing the bindings of this invention.

Referring to the drawings and particularly FIGS. 1 and 2, a slalom ski 20 is shown to be equipped with a front or toe piece binding 22, a heel piece binding 23 positioned behind the front binding 22, and a rear toe piece binding 24 positioned behind the heel piece binding 23 for holding the skier's feet in place on the ski. Ski 20 may be of any conventional construction.

Figure 3:
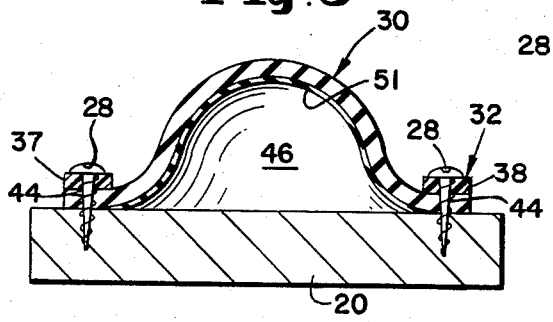
FIG. 3 is a section taken substantially along lines 3—3 of FIG. 2.
Figure 6:
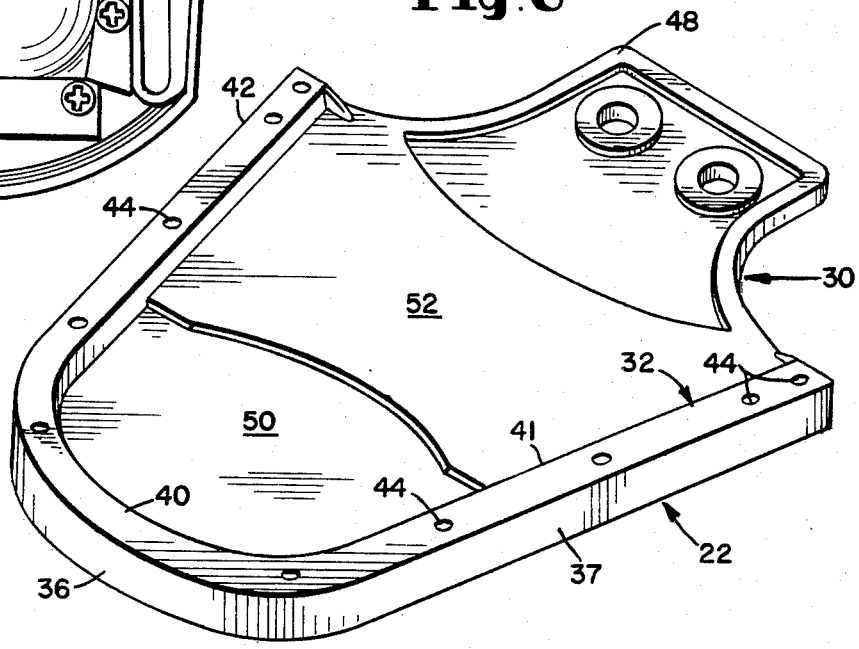
FIG. 6 is a perspective view of the front binding in its flattened, unflexed state.

Referring to FIGS. 2, 3 and 6, front binding 22, which is removably fastened to the ski by screws 28, is constructed in accordance with the principles of this invention and comprises a soft, pliable, flexible binding rubber portion 30 and a hard, horseshoe framework portion 32 which is bonded to and thus firmly joined to the binding rubber portion 30 during the molding process.

As shown in FIGS. 2 and 6, framework portion 32 overlies the binding rubber portion 30 immediately adjacent to the perimeter or edge 34 of binding rubber portion 30 so that the outer edges of portions 30 and 32 preferably lie flush with each other. The perimeter 34 of binding rubber portion 30 has a curved forward edge 36 and two spaced apart side edges 37 and 38 extending rearwardly from edge 36. Framework portion 32 follows the contour of perimeter 34 and therefore is formed with a forward curved segment 40 and two spaced apart legs 41 and 42 extending rearwardly from segment 40 to define a horseshoe configuration.

The rectangular transverse cross section of framework portion 32 is elongated in a direction extending parallel to the plane of binding rubber portion 30 when the latter is in its relaxed, unflexed, flattened out condition shown in FIG. 6. Screw holes 44 for snugly receiving screws 28 extend through portions 30 and 32 along parallel axes normally intersecting the longitudinal axis of framework portion 32.

In the binding's unflexed condition shown in FIG. 6, binding rubber portion 30 lies flat like a sheet or web, and the framework's legs 41 and 42 diverge away from each other in a rearwardly extending direction. Framework portion 32 is sufficiently flexible transversely of its longitudinal axis to permit legs 41 and 42 to be flexed at their junctions with the framework's curved segment 40. Upon mounting binding 22 on ski 20, legs 41 and 42 will be flexed at their junctures with curved segment 40 to extend parallel to one another and will be held in their parallel positions by screws 28 which extend through screw holes 44 and which are threaded into ski 20 or a binding plate (not shown) as shown in FIGS. 2 and 3. The region of binding rubber portion 30 underlying framework portion 32 will be compressed upon tightening screws 28. When legs 41 and 42 are flexed to extend parallel to one another, binding rubber portion 30 will be flexed to pucker or bulge up to define a foot-receiving pocket or cavity 46 for receiving the skier's forefoot portion as best shown in FIG. 3. Binding rubber portion 30 may be formed with a tongue 48 extending rearwardly of framework portion 32 to overlie the skier's upper foot portion.

Figure 7:
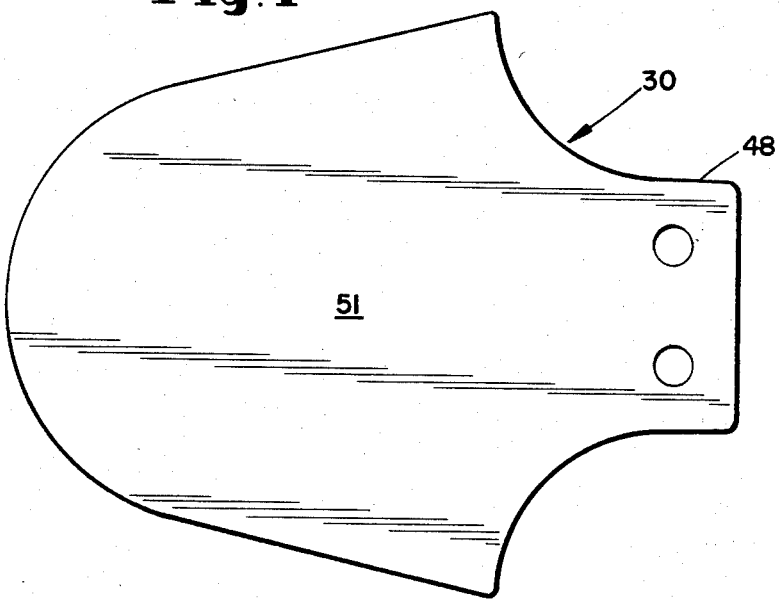
FIG. 7 is a bottom plan view of the front binding shown in FIG. 6.

In the embodiment shown in FIGS. 6 and 7, binding rubber portion 30 is of the laminate, foam-lined type having an outer, solid, unfoamed layer 50 of synthetic elastomeric material and a comfort-enhancing lining 51 (see FIG. 7) of a foamed polymeric material, which is preferably of a closed cell type. The foamed lining 51 is bonded to the outer unfoamed layer 50 in the process of molding the binding. The foamed lining 51 is optional and may be eliminated if desired. As shown in FIGS. 1–3 and 6, binding rubber portion 30 may optionally be molded with an outer reinforcing strap portion 52 extending between the framework's legs 41 and 42.

Binding rubber portion 30 is soft and stretchable and has a durometer hardness in the range of 30 to 70 shore durometer on the A scale. Preferably, the binding rubber portion 30 has a shore durometer of 40 on the A scale. Framework portion 32, on the other hand, is hard and rigid having a durometer hardness lying in the range of 50–80 shore durometer on the D scale. Framework portion 32 preferably has a durometer hardness of 75 shore durometer on the D scale.

The solid binding rubber layer 50 may be molded from any suitable polymeric material such as polyvinyl chloride together with an appropriate amount of plasticizer such as di-octyl-phlate. Framework portion 30 is also molded from a suitable polymeric material such as polyvinyl chloride together with an appropriate amount of a suitable plasticizer such as butyl-octyl-phlate. Any suitable, compatible formulations may be used for framework portion 32 and the binding rubber layer 50 to create at least a physical bond between framework portion 32 and layer 50 upon molding. A suitable PVC formulation for framework portion 32 is supplied by B. F. Goodrich under the tradename Geon 221. A suitable PVC formulation for layer 50 is suppled by B. F. Goodrich under the tradename Geon 121. It will be appreciated that the amount of plasticizer used with the plastic resin for each of the portions 30 and 32 determines the extent of hardness or, conversely, the softness of the material. The softer the material is the more stretch or elongation it will have. Therefore, binding rubber portion 30 has significant elongation or stretch. Owing to its much greater hardness, framework portion 32 has a much greater tensile strength than binding rubber portion 30.

Figure 10:
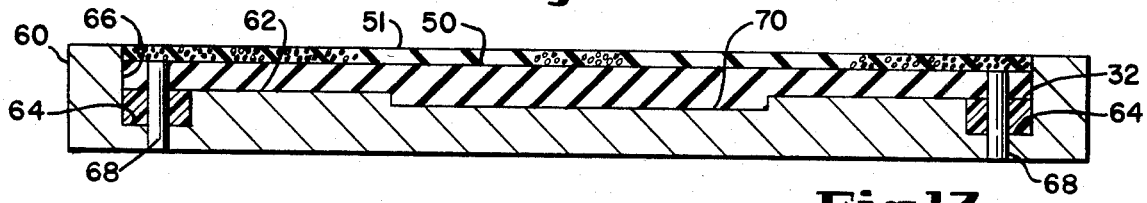
FIG. 10 is a transverse cross-section of a mold used for molding the front binding and showing the layers of resins in the mold.

Binding 22 is molded in any suitable type of mold such as the casting mold 60 shown in transverse cross section in FIG. 10. The bottom wall 62 of mold 60 is formed with an upwardly opening channel 64 having a configuration conforming to the desired configuration of the binding's framework. In the case of the front binding 22, channel 64 has a horseshoe configuration corresponding to the framework configuration shown in FIG. 6.

The process for molding binding 22 is as follows: First, the formulation for framework portion 32 is introduced preferably in its liquid state into channel 64, but not the remainder of the mold cavity, which is indicated at 66 in FIG. 10. Next, the formulation for layer 50 and strap portion 52 is introduced preferably in its liquid state into the mold to fill a strap cavity 70 and to form a liquid layer spanning the mold cavity 66 to overlie and come into intimate contact with the formulation in channel 64. Then, the mold is heated in an oven to about 180° F. to gel, but not cure the formulations making up framework portion 32 and layer 50. A suitable formulation for the foamed lining 51 is then introduced into the mold over the gelled composite, and the mold is heated to about 400° F. for about 8 to 10 minutes to blow the formulation for the foamed lining and to cure and solidify the plastic formulations in the mold.

Upon heating and curing the formulations for framework portion 32 and layer 50, the two formulations become fused to one another to bond portion 32 and layer 50 to each other throughout the entire interface between portion 32 and layer 50. The bond between portion 32 and layer 50 is considered to be a physical bond and arises due to the intimate contact between the two liquid formulations in the mold.

After the mold has been cooled, the molded binding is removed from the mold. The finished part may then be installed on a water ski using screws 28 and washers, if needed.

If it is desired to omit strap portion 52, the mold cavity 70 is omitted, and the preceding molding procedure is followed, omitting any steps pertaining to strap portion 52. If it is desired to eliminate the foamed lining 51, the same molding procedure is followed, except that the steps for forming the lining are omitted.

The bond between portions 30 and 32 spreads the stresses applied to portion 30 in the region of screw holes 44 and thus alleviates, if not eliminates failures due to tearing in normal usage of the ski. Depending upon the formulations used for portion 32 and layer 30, a chemical bond may also be created, but the physical bond itself is sufficient to prevent or alleviate such failures.

Figure 5:
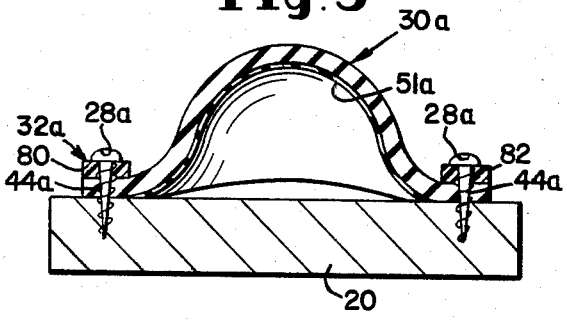
FIG. 5 is a section taken substantially along lines 5—5 of FIG. 2.
Figure 9:
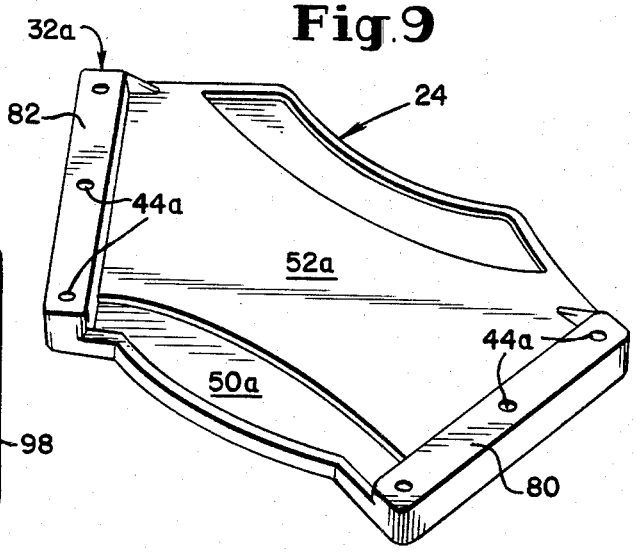
FIG. 9 is a perspective view of the rear binding in its flattened, unflexed state.

Referring to FIGS. 2, 5 and 9, binding 24 is also removably fastened by suitable fasteners such as screws **28*a* to ski 20. Except for their configurations, bindings 22 and 24 are essentially of the same construction. Accordingly, like reference numerals have been applied to designate like portions of the two binding except that the reference numerals used for binding 24 have been suffixed by the letter "a" to distinguish them from the reference characters used for binding 22**.

Binding 24 is of the open toe type and thus is open at both ends as shown in FIG. 2. Framework portion **32*a* is thus divided into two side segments 80 and 82. Segments 80 and 82 overlie and extend along the marginal side edges of binding rubber portion 30*a*. Each of the framework segments 80 and 82 is bonded to binding rubber portion 30*a* throughout the entire innerface between the binding rubber portion and the framework segments in the same manner just described for binding 22. The procedure for molding binding 24 corresponds to that previously described for binding 22. The durometer hardness of portions 30*a* and 32*a* are the same as those previously specified for portions 30 and 32**.

As shown, the oppositely facing side edges of framework segments 80 and 82 lie flush with the oppositely facing side edges of binding rubber portion **30*a*. Like binding 22, the screw holes 44*a* extend through framework segments 80 and 82 and also through the underlying regions of binding rubber portion 30*a*. The rectangular cross section of each of the segments 80 and 82 is elongated in the direction of the plane of binding rubber portion 30*a* when the latter lies in its flattened, unflexed state as shown in FIG. 9**.

When binding 24 is in its flattened, unflexed condition as shown in FIG. 9, framework segments 80 and 82 diverge away from each other in a rearwardly extending direction. When segments 80 and 82 are drawn parallel or at least generally parallel to one another to mount binding 24 on ski 20, binding rubber portion **30*a* will be flexed to bulge or pucker up thus defining the foot-receiving pocket or cavity 46*a*. Binding rubber 30*a* will be constrained or retained in this flexed condition upon fastening binding 24 to ski 20**.

Like binding 22, the foamed lining **51*a* and the outer reinforcing strap portion 52*a* are optional and may be omitted if desired. Materials used for molding binding 24 are the same as those used for binding 22**.

Referring to FIGS. 1 and 2 again, the heel piece binding 23 is used with a rigid bracket 90. Bracket 90 may be of any suitable, conventional construction and is removably mounted on ski 20 by suitable fasteners 92 which extend through longitudinally elongated apertures 93 in the bracket to enable the bracket to be selectively adjusted relative to front binding 22 to provide a comfortable fit for the skier's foot.

To the extent that bindings 22 and 23 are alike, like reference numerals have been applied to designate like portions except that the reference numerals used for binding 23 have been suffixed by the letter "b" to distinguish them from the reference characters used for binding 22.

Figure 4:
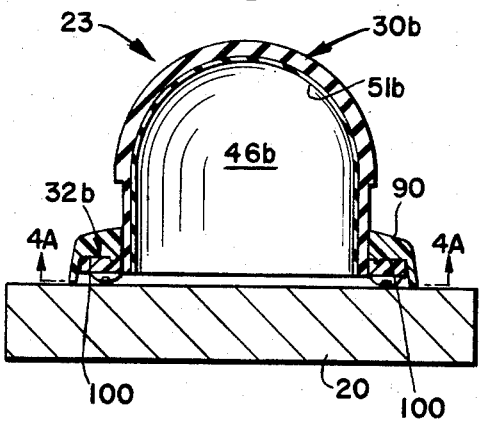
FIG. 4 is a section taken substantially along lines 4—4 of FIG. 2.
Figure 4A:
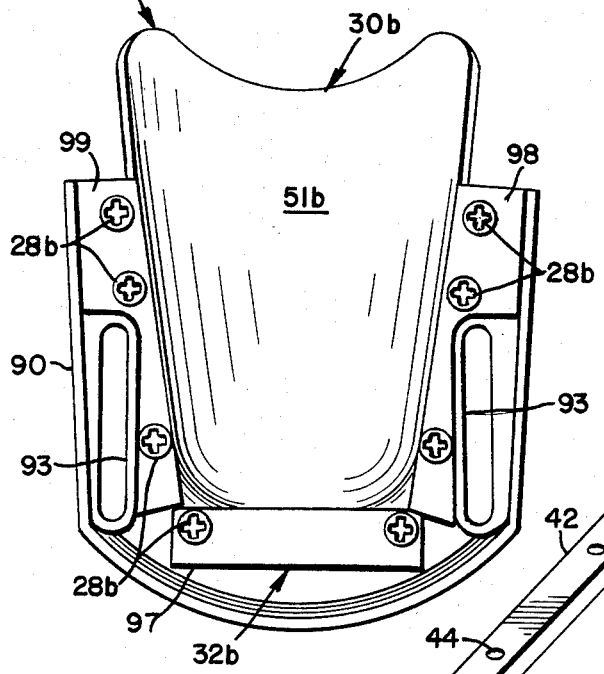
FIG. 4A is a bottom plan view of the heel piece binding shown in FIGS. 1 and 2.

Like the construction described for binding 22, binding 23 is molded with a hard framework portion **32*b* and a soft, flexible binding rubber portion 30*b*. Portions 30*b* and 32*b* are bonded to each other throughout the entire interface between the two portions in the same manner described for binding 22. In contrast to the construction shown for binding 22, however, framework portion 32*b* is molded with slits 94 to divide the framework portion into a front segment 97 and two side segments 98 and 99. Segments 97–99 are received in a downwardly opening, generally horseshoe shaped cavity 100 or recess which is formed in the base of bracket 90 as shown in FIG. 4**

Figure 8:
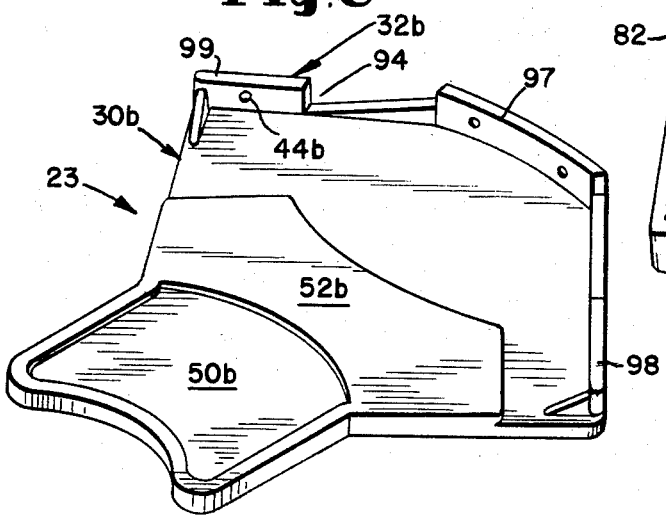
FIG. 8 is a perspective view of the one-piece heel piece binding in its flattened, unflexed state.

As best shown in FIG. 8, framework portion **32*b* extends along only the rearward perimeter portion of binding rubber portion 30*b*. The rear perimeter of binding rubber portion 30*b* is received in the horseshoe opening of the bracket 90 as best shown in FIG. 2. The rectangular cross sections of each of the framework segments 97–99 is elongated in a direction extending normal, rather than parallel, to the plane of binding rubber portion 30*b* when the binding rubber portion is in its flattened, unflexed condition shown in FIG. 9. In this embodiment, the screw holes 44*b* are formed through framework segments 97–99, but not through the binding rubber portion 30*b*. In assembled relation with bracket 90, framework segments 97–99 are flexed outwardly to lie parallel with the upper surface of ski 20. Screws 28*b* extending through holes 44*b* detachably fasten binding 23 to bracket 90**.

Upon assembly of binding 23 with on bracket 90, binding rubber portion **30*b* will be flexed to bulge or pucker up to define a pocket 46*b*** for receiving the skier's heel.

Like the front and rear bindings, the illustrated foam lining **51*b* and the outer reinforcing strap portion 52*b* are optional and may be omitted if desired. The durometer hardnesses of portions 30*b* and 32*b* are preferably the same as those specified for portions 30 and 32** in binding 22. The materials used to mold binding 23 are the same as those used for binding 22.

Figure 11:
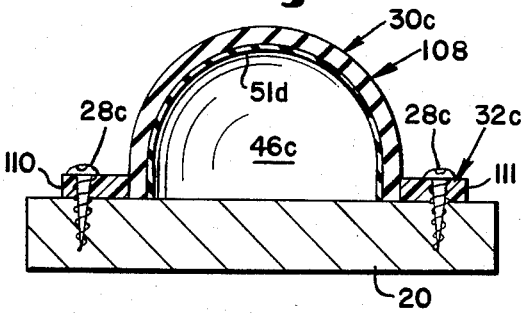
FIG. 11 is a section similar to FIG. 3 but illustrating a modified form of the front binding.
Figure 12:
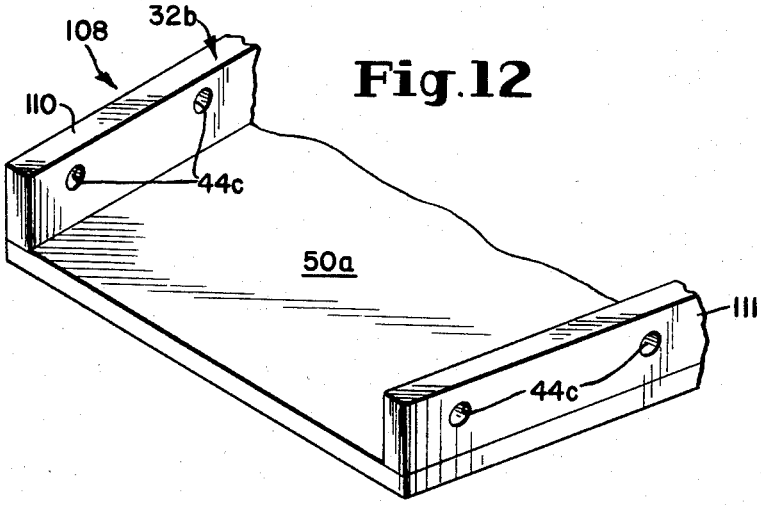
FIG. 12 is a fragmentary perspective view showing the modified binding in its flattened, unflexed state.

The front binding 108 shown in FIGS. 11 and 12 is the same as that shown in FIGS. 1, 3 and 6 with two exceptions. To the extent that the two embodiments are alike, like reference numerals have been applied to designate like portions of the two bindings except that the reference numerals is used for the embodiment of FIGS. 11 and 12 have been suffixed by the letter "c" to distinguish them from the reference numerals used for the previous embodiments.

In the embodiment of FIGS. 11 and 12, binding 108 is of the open toe type and is therefore open at both ends. Additionally, framework 32*c* is divided into two side segments 110 and 111, and the rectangular cross section of each segment is elongated in a direction extending normal, rather than parallel, to the plane of binding rubber portion 30*c* when the binding rubber portion is in its flattened, unflexed condition as shown in FIG. 12.

In the embodiment of FIGS. 11 and 12, the screw holes 44*c* are formed only through the framework segments 110 and 111 and thus are not formed through the binding rubber portion 30*c*. The longitudinal axes of screw holes 44*c* lie parallel to the plane of binding rubber portion 30*c* when the latter is in its flattened unflexed condition thown in FIG. 12.

Framework segments 110 and 111 diverge away from each other in a rearwardly extending direction when the binding is in its flattened, unflexed condition shown in FIG. 12. Upon orienting framework segments 110 and 111 parallel to one another and upon inserting screws 28*c* to fasten the binding to ski 20, binding rubber portion 30*c* will be flexed to pucker or bulge upwardly to form the foot receiving cavity 46*c*.

In the flexed, assembled condition of binding 108 on ski 20, framework portions 110 and 111 do not overlie binding rubber portion 30*c* and instead lie flat against ski 20 in such a manner that the rectangular cross sections of framework segments 110 and 111 are elongated in a direction extending parallel to the top face of ski 20.

As shown in FIG. 11, the outer oppositely facing side edges of framework segments 110 and 111 may lie flush with the oppositely facing side edges of ski 20. With this construction, the maximum width of binding 108 may be reduced without reducing or at least significantly reducing the width of the foot-receiving cavity 46*c*. The maximum width of binding 108 is therefore significantly smaller than the maximum width of binding 22, but yet does not correspondingly reduce the maximum width of the foot-receiving cavity. The water ski may therefore be made narrower for improved maneuverability without requiring a reduction in the size of the foot-receiving cavity and thus avoiding a tight discomforting fit around the skier's foot.

Figure 13:
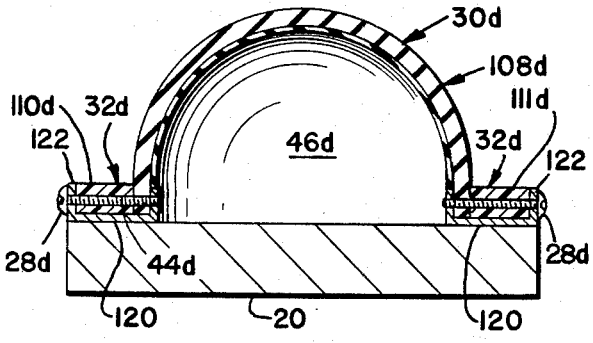
FIG. 13 is a fragmentary transverse section showing a modified mode of attachment for the binding of this invention.

FIG. 13 illustrates a modified mode of attachment for the type of binding shown in FIGS. 11 and 12. To the extent that these embodiments are alike, like reference numerals have been used to designate like parts except that in the reference numerals used to identify the portions of the binding in FIG. 13 have been suffixed by the letter "d".

In the embodiment in FIG. 13, screw holes 44*d* extend through both the framework and binding rubber portions 30*d* and 32*d*. The axes of screw holes 44*d* extend normal to the plane of binding rubber portion 30*d* when the binding rubber portion is in its flattened, unflexed condition. When binding rubber portion 30*d* is flexed to form the foot-receiving cavity 46*d* as when the binding is fastened to the ski, the longitudinal axes of screw holes 44*d* extend parallel to the top face of ski 20 as shown in FIG. 13.

Still referring to FIG. 13, binding 108*d* is seated on a binding plate 120 or other suitable part having upwardly turned ears or side flanges 122 extending vertically upwardly from the top surface of ski 20. Plate 120 is fixed to ski 20 by any suitable means (not shown). Framework segments 110*d* and 111*d* seat against flanges 122 to confine the binding 108*d* between flanges 122. Suitable fasteners 28*d* such as screws or bolts, extend through holes 44*d* and aligning apertures in flanges 122 to removably fasten binding 108*d* to plate 120.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. As an article of manufacture, a one piece, integral water ski binding for receiving a portion of a skier's foot and comprising a flexible binding rubber portion integrally joined to framework portion, said binding rubber portion being flattenable to an unflexed condition when unattached to a ski or other part, said framework portion being harder than said binding rubber portion, said framework portion comprising one or more segments each having a quadrilateral cross section which extends transversely of said binding rubber portion when said binding rubber portion is flattened to said unflexed condition, said framework portion having fastener receiving holes formed only through said framework portion and not through said binding rubber portion, said holes being arranged for receiving fasteners for fastening said water ski binding to a water ski or a part mounted on a water ski, said framework portion extending outwardly from said binding rubber portion to overlie said ski when said binding rubber portion is flexed to form the foot receiving cavity.

2. The article of manufacture defined in claim 1, wherein said binding portion is formed from a polymeric material, wherein said framework portion is also formed from a polymeric material and wherein said framework portion is bonded to said binding rubber portion.

3. The article of manufacture defined in claim 1, wherein said binding is a front binding for restraining the forefoot portion of a skier's foot.

4. The article of manufacture defined in claim 1, wherein said binding is a heel piece binding for restraining the heel portion of a skier's foot.

5. The article of manufacture defined in claim 1, wherein said ski is a slalom ski, and wherein said binding is a rear binding for restraining the forefoot portion of the skier's rearwardly placed foot on the slalom ski.

6. The water ski binding defined in claim 1, wherein said framework portion has a pair of segments which diverge away from each other when said binding rubber portion is in its flattened, unflexed condition and which extend at least approximately parallel to each other when said binding rubber portion is flexed to form a cavity for receiving a portion of the skier's foot.

7. The article of manufacture defined in claim 1, wherein said water ski binding comprises an additional foot portion restraint secured to a water ski comprising a horseshoe framework portion having a front segment and a pair of spaced apart legs integrally joined to and extending rearwardly from said front segment, and a central binding rubber portion joining said front segment and legs, said central binding rubber portion being flattenable to an unflexed condition when unattached to a ski or other part, said legs diverging away from each other when said central binding rubber portion is in said unflexed condition, and said horseshoe framework portion being sufficiently flexible at the junctures between said legs and front segment to enable said legs to flex at said junctures to extend at least approximately parallel to each other when said central binding rubber portion is flexed to form a cavity for receiving an additional portion of the skier's foot.

8. Thearticle of manufacture defined in claim 1, wherein said framework portion has a durometer hardness lying in the range extending from 50 to 80 shore on the D scale, and wherein said binding rubber portion has a durometer hardness lying in the range extending from 30 to 70 shore on the A scale.

9. The article of manufacture defined in claim 1, wherein said framework portion has a durometer hardness of approximately 75 shore on the D scale, and wherein said binding rubber portion has a durometer hardness of approximately 40 shore on the A scale.

10. The article of manufacture defined in claim 1, wherein said binding is a molded unitary part.

11. The article of manufacture defined in claim 1, wherein said framework and binding rubber portions are fused to one another.

12. The article of manufacture defined in claim 1, further comprising at least one additional foot portion receiving means for attachment to a water ski or the like.

13. The article of manufacture defined in claim 1, further comprising at least two additional foot portion receiving means for attachment to a water ski or the like.

14. The article of manufacture defined in claim 1, further comprising a pair of said water ski bindings and a pair of additional foot portion receiving means for attachment to a water ski or the like, one of said water ski bindings and one of said additional foot portion receiving means being adapated for attachment to a single water ski, the other of said water ski bindings and the other of said additional foot portion receiving means being adapted for attachment to an additional water ski.

15. Thearticle of manufacture defined in claim 14, further comprising a third, additional foot portion receiving means for attachment to a water ski.

16. The article of manufacture as claimed in claim 13, further comprising, in combination, an otherwise conventional slalom ski.

17. The article of manufacture as claimed in claim 14, further comprising, in combination, a pair of otherwise conventional water skis.

18. The article of manufacture as claimed in claim 15, further comprising, in combination, a pair of otherwise conventional water skis, one of said skis being a slalom ski.

* * * * *